US009209525B2

(12) United States Patent
Schantz et al.

(10) Patent No.: US 9,209,525 B2
(45) Date of Patent: Dec. 8, 2015

(54) DIRECTIVE, ELECTRICALLY-SMALL UWB ANTENNA SYSTEM AND METHOD

(75) Inventors: Hans Gregory Schantz, Hampton Cove, AL (US); Robert Edward DePierre, Huntsville, AL (US)

(73) Assignee: Q-Track Corporation, Huntsville, AL (US)

( * ) Notice: Subject to any disclaimer, the term of this patent is extended or adjusted under 35 U.S.C. 154(b) by 674 days.

(21) Appl. No.: 13/436,956

(22) Filed: Apr. 1, 2012

(65) Prior Publication Data

US 2013/0027249 A1 Jan. 31, 2013

Related U.S. Application Data

(60) Provisional application No. 61/470,735, filed on Apr. 1, 2011.

(51) Int. Cl.
*H01Q 21/20* (2006.01)
*H01Q 3/26* (2006.01)

(52) U.S. Cl.
CPC . *H01Q 21/20* (2013.01); *H01Q 3/26* (2013.01)

(58) Field of Classification Search
USPC ..... 342/81, 368, 369, 372; 343/785, 884, 343/905
See application file for complete search history.

(56) References Cited

U.S. PATENT DOCUMENTS

| | | | | |
|---|---|---|---|---|
| 1,381,089 A | | 6/1921 | Beverage | |
| 1,434,984 A | | 11/1922 | Beverage | |
| 1,546,878 A | | 7/1925 | Alexanderson | |
| 1,555,345 A | | 9/1925 | Willoughby | |
| 2,086,976 A | | 7/1937 | Brown | |
| 2,247,743 A | | 7/1941 | Beverage | |
| 2,659,004 A | | 11/1953 | Lindenblad | |
| 3,202,995 A | | 8/1965 | Schultz | |
| 3,441,935 A | | 4/1969 | Leitner | |
| 3,860,928 A | * | 1/1975 | Ehrlich | 342/375 |
| 3,953,799 A | | 4/1976 | Albee | |
| 4,171,525 A | | 10/1979 | Seeley | |
| 4,442,434 A | | 4/1984 | Baekgaard | |
| 4,540,988 A | | 9/1985 | Munk | |
| 4,649,391 A | * | 3/1987 | Tsuda et al. | 342/153 |

OTHER PUBLICATIONS

Beverage et al, "The Wave Antenna: A New Type of Highly Directive Antenna," Transactions AIEE, Feb. 1923, pp. 215-266.
Manneback, "Radiation from transmission lines," Transactions AIEE Feb. 1923 pp. 289-301.
Koontz, Floyd, "Is this Ewe for You'?," QST, Feb. 1995, pp. 31-33.
(Continued)

*Primary Examiner* — Dao Phan

(57) ABSTRACT

A directive electrically small antenna (DESA) process and method employs multipole synthesis to implement directive electrically small multipole antennas with ultra-wideband (UWB) stable antenna patterns. Although lossy, embodiments have adequate efficiency to work as receive antennas in the high ambient noise environment of the HF band and below. Employing a process dubbed "antenna regeneration," energy may be circulated within an antenna by means other than resonance. This enables multiple decade UWB response without the efficiency penalties inherent to traditional resistively-loaded antenna systems. Regenerative antennas can simultaneously achieve the performance of high Q resonant antennas and the bandwidth of resistively loaded antennas.

17 Claims, 8 Drawing Sheets

(56) References Cited

OTHER PUBLICATIONS

Figure 1:
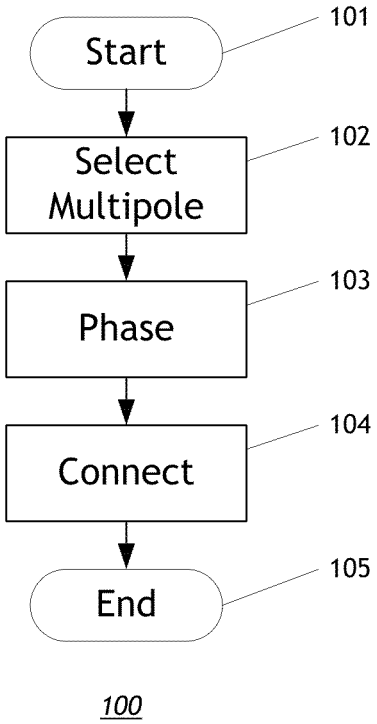

Koontz, Floyd, "More EWEs for You," QST, Jan. 1996, pp. 32-34.
Breed, Gary, "The K9AY Terminated Loop—A Compact, Directional Receiving Antenna," QST, Sep. 1997, pp. 43-46.
Cunningham, Earl W., "Flags, Pennants and Other Ground-Independent Low-Band Receiving Antennas," QST, Jul. 2000, pp. 34-37.
Farr, Everett G. et al, "An incident field sensor for EMP measurements," Sensor and Simulation Notes #312, Nov. 6, 1989.

* cited by examiner

400

420

DIRECTIVE, ELECTRICALLY-SMALL UWB ANTENNA SYSTEM AND METHOD

Development funded by DARPA under Contract No. W31P4Q-10-C-0078 and by the U.S. Air Force under Contract No. FA8718-09-C-0024. This applications claims priority to Provisional Patent Application 61/470,735 filed Apr. 1, 2011.

1 BACKGROUND

When operated at "low" frequencies, traditional quarter-wavelength antennas become prohibitively large for certain applications. For example, a quarter-wavelength monopole operating at 10 MHz has a physical size of 7.5 m. This may be acceptable for an outdoor antenna (for instance), but would be impractical for a compact hand-held device. Thus, an antenna designer must employ electrically-small antenna (ESA) techniques in order to transmit and receive signals effectively using an antenna considerably smaller than this natural quarter-wavelength scale.

An ESA is one whose size is on the order of the "radiansphere" or smaller. The radiansphere is the hypothetical sphere of radius $\lambda/2\pi$ centered on the antenna. It marks the transition between the near field and far field regions or where energy is stored and radiated around an antenna [H. A. Wheeler, "Fundamental Limitations of Small Antennas," Proc. IRE, 35, December 1947, pp. 1479-1484].

As a designer shrinks an antenna smaller than quarter-wavelength scale, the design requires reactive loading to ensure that the small antenna resonates at the proper frequency. More reactive loading means more stored reactive energy, and a higher quality factor or "Q." Q also increases as one reduces loss. A higher Q generally implies a more efficient transmit antenna and a more sensitive receive antenna.

However, the higher the Q, the narrower the bandwidth and the less stable the antenna. Particularly high Q antennas exhibit narrow bandwidth and may be thrown off frequency by changes in their surroundings, temperature variations, or other factors. Antenna designers must make a tradeoff between two mutually exclusive goals: high Q and high efficiency, on the one hand, and stability and bandwidth on the other hand. This fundamental "tyranny of resonance" limits the practical implementation of ultrawideband (UWB), high efficiency, and directional electrically small antenna designs.

In short, there exists a significant need for higher efficiency, electrically small antennas, particularly directive and broadband or UWB small antennas.

2 SUMMARY OF THE INVENTION

A directive, electrically-small UWB antenna system and method neatly sidesteps the tyranny of resonance. This system and method employs multipole synthesis to implement electrically-small multipole antennas with ultra-wideband (UWB) stable antenna patterns. In many embodiments, these antennas are directive with at least cardioid-like patterns. Although lossy, embodiments have adequate efficiency to work as receive antennas in the high ambient noise environment of the HF band and below. The present invention also introduces the concept of antenna regeneration to achieve a higher efficiency over a broader bandwidth than has traditionally been thought possible—multiple frequency decades in some cases.

A process for synthesizing a directive, electrically-small antenna (DESA) comprises the steps of selecting a multipole configuration, phasing of radiation centers, and connecting radiation centers. Connecting radiation centers preferentially involves using impedance-matched transmission lines. The phasing of radiation centers substantially cancels the pattern of the electrically small antenna in a particular direction so as to yield a directive antenna pattern. In preferred embodiments, beam widths on the order of 90 deg×90 deg are achieved.

Employing a process dubbed "antenna regeneration," energy may be circulated within an antenna by means other than resonance. This enables multiple decade UWB response without the efficiency penalties inherent to traditional resonant antenna systems. Regenerative antennas can simultaneously achieve the performance of high Q resonant antennas and the bandwidth of resistively loaded antennas. The invention includes a process of transmit antenna regeneration comprising the steps of launching a wave, emitting radiation energy, recovering non-radiated energy, and reusing non-radiated energy. In a preferred embodiment, the step of recovering non-radiated energy employs rectification and the step of reusing non-radiated energy inputs the non-radiated energy to an amplifier. In alternate embodiments, the step of reusing non-radiated energy employs a transformer coupling. In some embodiments, the process of launching a wave occurs in and around a multipole antenna system.

The invention further includes an electrically small directive antenna system comprising a multipole configuration of radiation centers, the radiation centers emitting or receiving signals, and the radiation centers phased so as to yield a substantial cancellation of the signals in at least one direction and a directive antenna pattern. The electrically small directive antenna system may further include a twin lead transmission line or a load. The load may be regenerative. Finally, the present invention describes a regenerative antenna system comprising a plurality of radiation centers at least one of which is a regenerative load. The regenerative load, may employ rectification, transformer coupling, amplification, or phase shifters.

3 BRIEF DESCRIPTION OF THE DRAWINGS

FIG. 1 shows a process flow diagram for directive electrically small antenna synthesis.

Figure 2A:
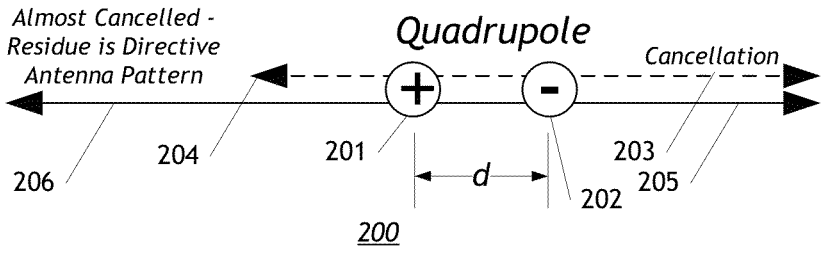

FIG. 2*a* presents a signal diagram of a directive quadrupole antenna system.

Figure 2B:
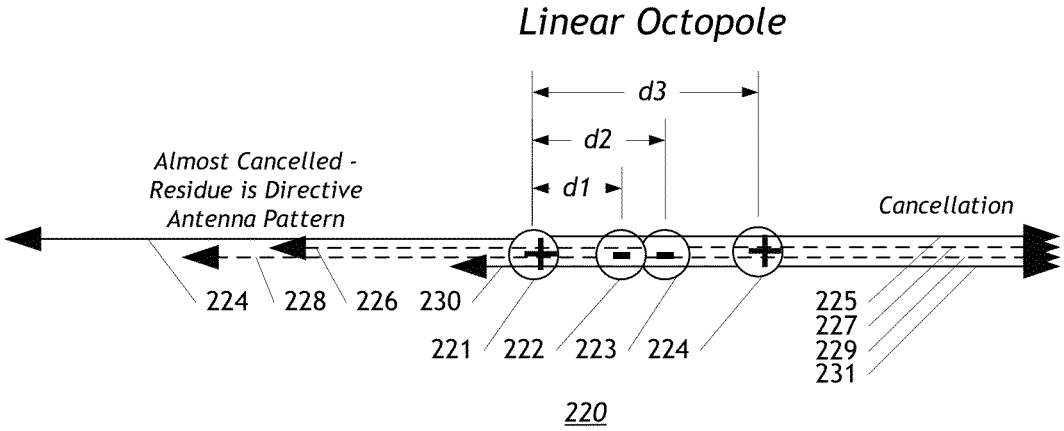

FIG. 2*b* presents a signal diagram of a directive linear octopole antenna system.

Figure 2C:
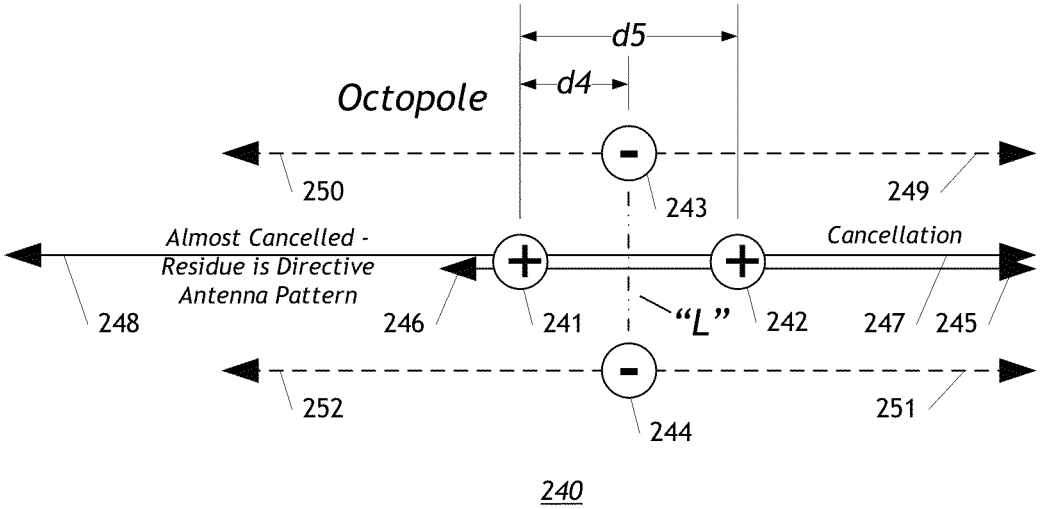

FIG. 2*c* presents a signal diagram of a directive octopole antenna system.

Figure 3A:
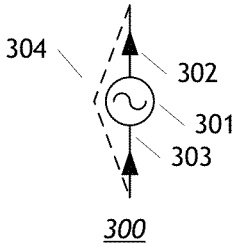
Fig. 3a (Prior Art)

FIG. 3*a* shows a diagram of a prior art center-fed small dipole element.

Figure 3B:
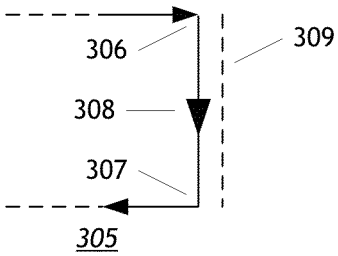

FIG. 3*b* shows a diagram of an end-fed small dipole element.

Figure 3C:
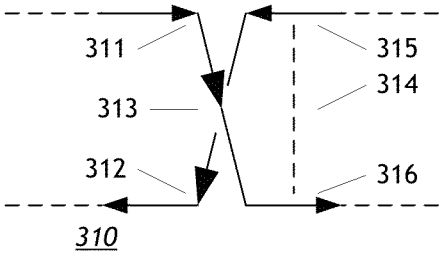

FIG. 3*c* shows a diagram of a cross-over end-fed small dipole element

Figure 3D:
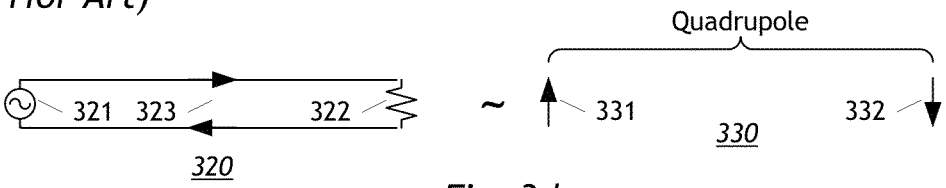

FIG. 3*d* shows the equivalence of a first directive electrically small transmit antenna with a quadrupole distribution.

Figure 3E:
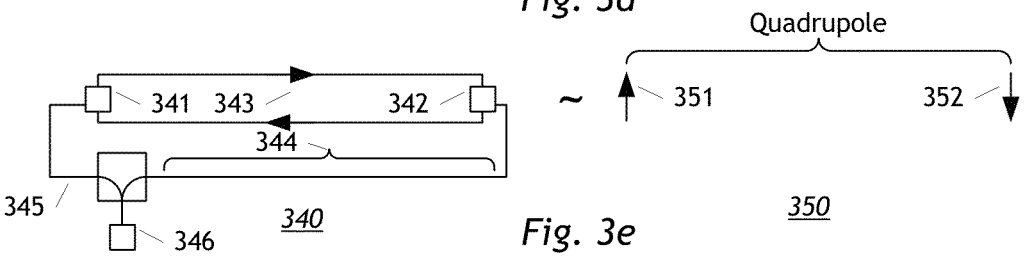

FIG. 3*e* shows the equivalence of a first directive electrically small receive antenna with a quadrupole distribution.

Figure 3F:
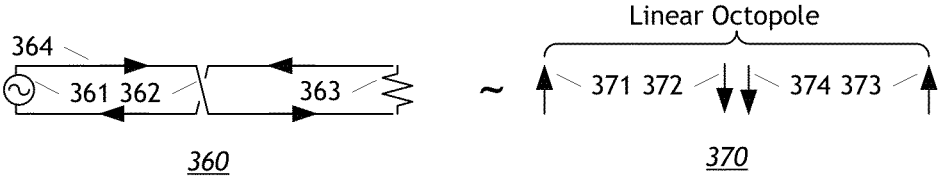

FIG. 3*f* shows the equivalence of a second directive electrically small transmit antenna with a octopole distribution.

Figure 3G:
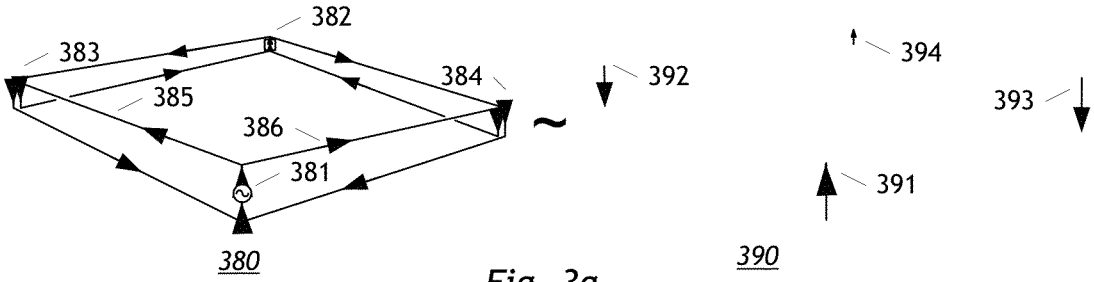

FIG. 3*g* shows the equivalence of a third directive electrically small transmit antenna with a linear octopole distribution.

Figure 4A:
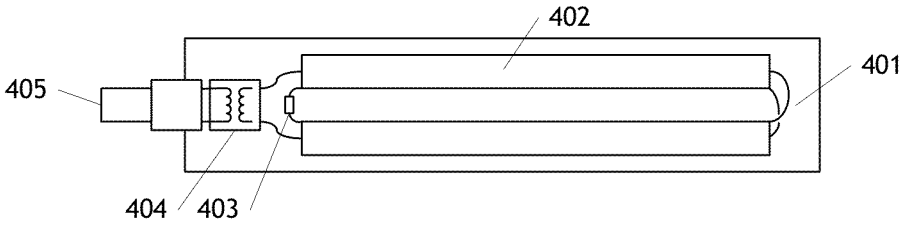

FIG. 4*a* presents a preferred embodiment directive quadrupole antenna system.

Figure 4B:
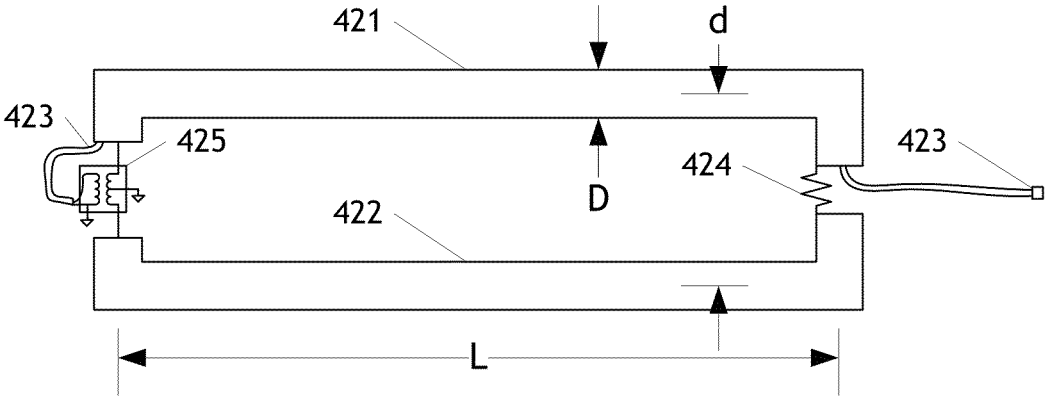

FIG. 4*b* presents an alternate embodiment directive quadrupole antenna system.

Figure 5A:
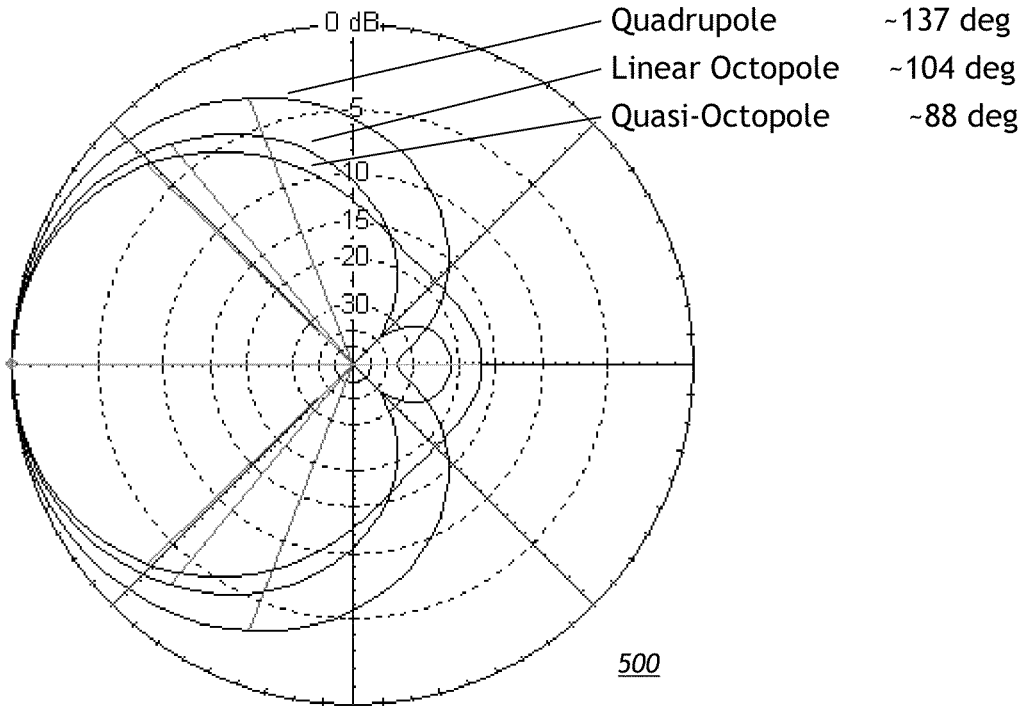

FIG. 5*a* shows typical azimuthal patterns for DESAs.

Figure 5B:
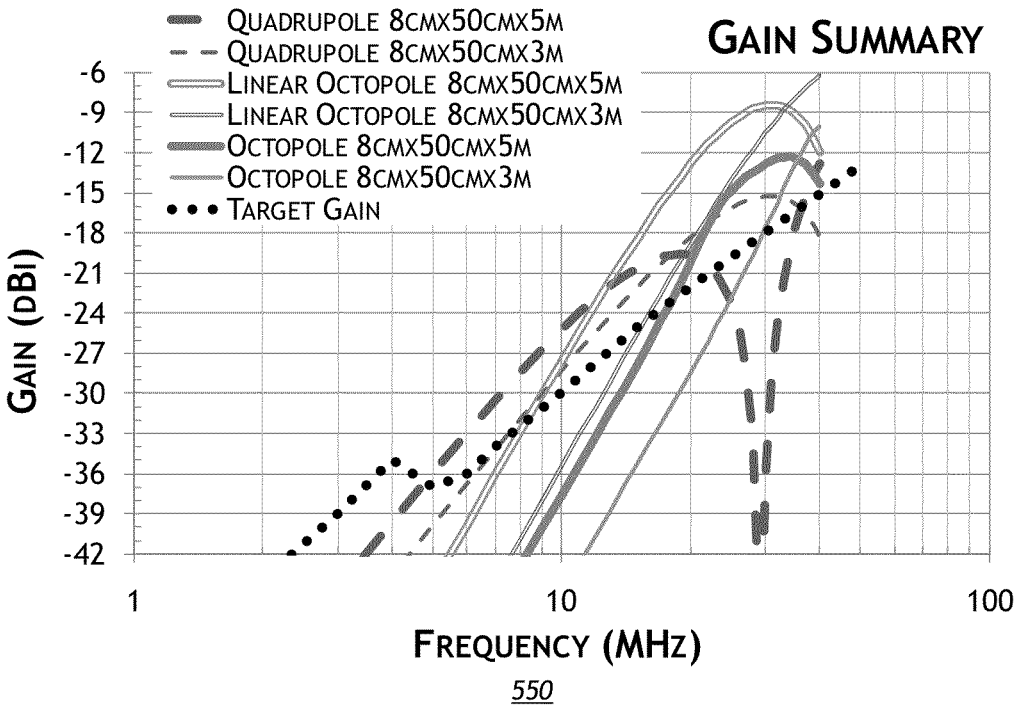

FIG. 5*b* shows gain versus frequency results for DESAs compared to target gain.

Figure 6A:
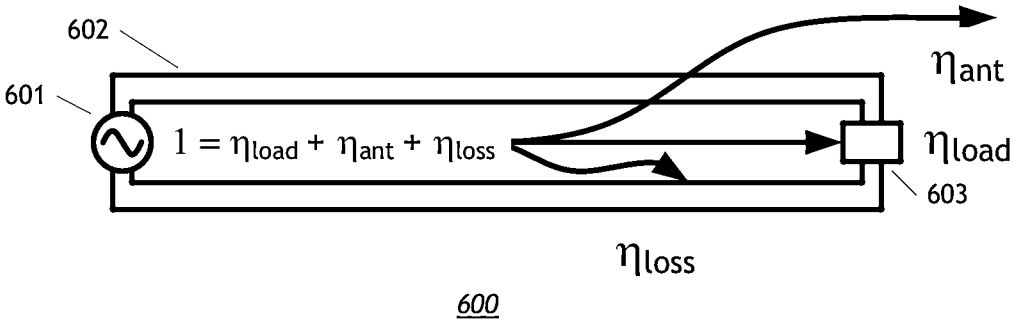

FIG. 6*a* shows a power flow diagram for a conventional antenna system.

Figure 6B:
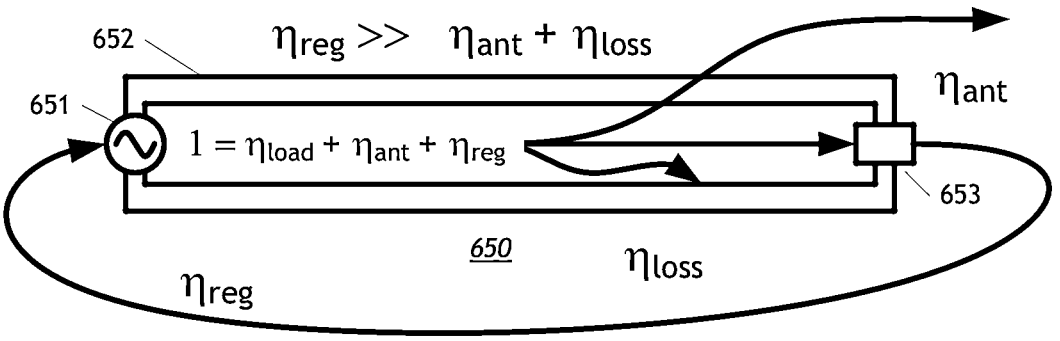

FIG. 6*b* shows a power flow diagram for a regenerative antenna system.

Figure 7A:
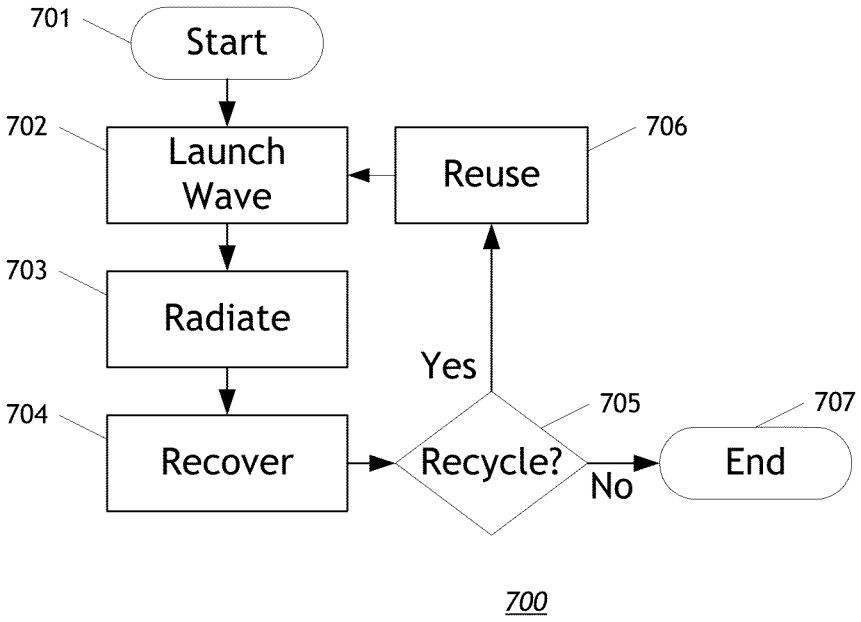

FIG. 7*a* shows a process flow diagram for transmit antenna regeneration.

Figure 7B:
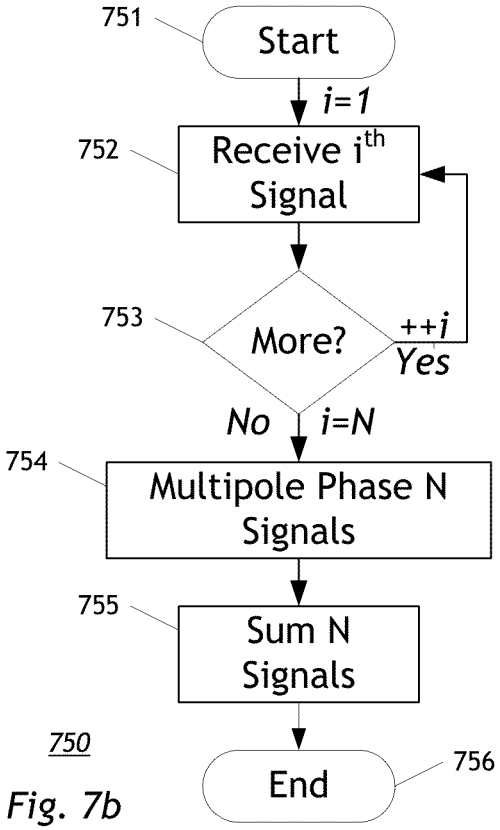

FIG. 7*b* shows a process flow diagram for receive antenna regeneration.

Figure 8A:
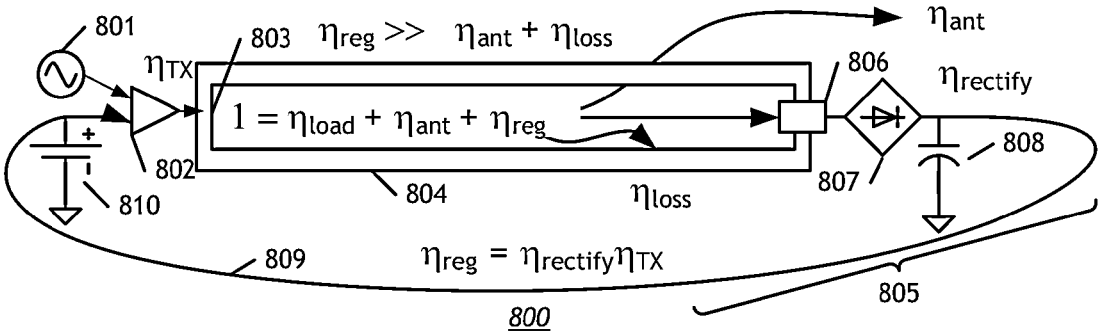

FIG. 8*a* shows a power flow diagram for a rectifying regenerative antenna system.

Figure 8B:
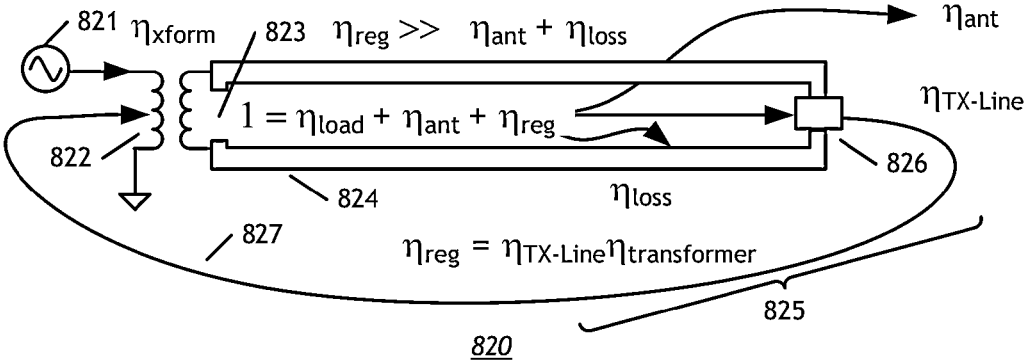

FIG. 8*b* shows a power flow diagram for a transformer coupled regenerative antenna system.

Figure 8C:
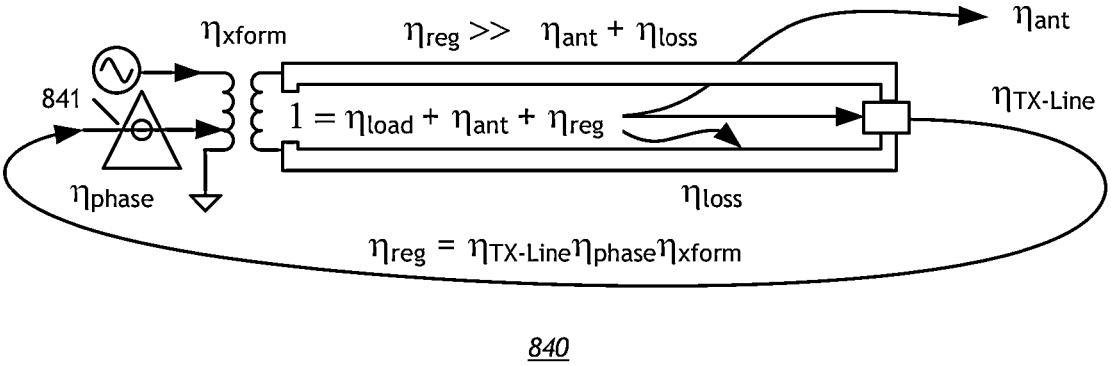

FIG. 8*c* shows a power flow diagram for a phase-corrected transformer-coupled regenerative antenna system.

4 DETAILED DESCRIPTION OF THE PREFERRED EMBODIMENTS

4.1 Overview of the Invention

The present invention relates to directive, electrically small antennas and related systems and processes. This disclosure will now describe the present invention more fully in detail with respect to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the antenna arts. Like numbers refer to like elements throughout.

4.2 Directive, Electrically Small Antenna Synthesis

An ideal square antenna aperture with side of length in wavelength $L_\lambda$ has directivity $D=4\pi L_\lambda^2$ and half power beamwidths of $50.8°/L_\lambda$ [John D. Kraus, *Antennas* (3$^{rd}$ ed.), (New York, McGraw-Hill, 2001), p. 147]. Thus, obtaining high directivity usually requires a multiple wavelength dimension aperture—impractical for physically small low frequency antennas. A variety of challenges, including the tyranny of resonance, have thwarted previous attempts to generate electrically small antennas, particularly directive ones.

The inventors have developed a novel method for designing and implementing directive, electrically small antennas: multipole synthesis. A multipole is a superposition of a plurality of dipoles or dipole-like sources. The simplest electrically small antennas may typically be thought of as dipoles. Two dipoles may be superimposed in opposite orientations and offset so as to yield a quadrupole. Two quadrupoles may be superimposed in opposite orientations and offset to yield an octopole, and so on. FIGS. 3*d*-3*g* present several examples of multipole antenna systems—antennas whose behavior emulates or approximates that of a multipole.

One should understand that antennas may be used in two modes: to transmit or to receive electromagnetic signals. Use of terminology describing one mode in a description of an antenna system should not be interpreted so as to preclude an alternate implementation of an antenna system employing the other mode of operation.

First, one must be able to predict the pattern behavior of multipole antennas and determine the appropriate multipole moments that will give rise to a desired pattern. Second, naïve attempts to superimpose electrically small antenna elements in opposite orientations do not, necessarily, yield a multipole because of mutual coupling or coupling to feed lines or support structures. Thus, it is difficult to create even simple multipole combinations like quadrupoles or octopoles. Finally, the more directive a superposition, the less its absolute gain, and the more steeply will the gain rolloff with decreasing frequency. There is a point of diminishing returns to making more directive, electrically small antennas. The present invention traverses these substantial difficulties in a variety of ways.

Harrington found the maximum directivity ($D_{max}$) of a multipole expansion of spherical waves to the $N^{th}$ order [Roger F. Harrington, *Time-Harmonic Fields*, (New York: McGraw-Hill Book Company, 1961), pp. 307-309].

$$D_{max} = \sum_{n=1}^{N} (2n+1) = N^2 + 2N \tag{1}$$

This limit may not be a sufficiently stringent bound, however, because (1) assumes a classical directivity calculation: integrating over the solid angle spherical shell. This means that the theoretically ideal directivity may be achieved with multilobe patterns instead of the desired one mainlobe with minimal side/back lobes that is the aim of the present invention.

FIG. 1 shows a process flow diagram for directive electrically small antenna (DESA) synthesis, illustrating the method of the present invention. A method for DESA synthesis 100 begins at a Start Block 101. The DESA synthesis process 100 continues with Selection of a Multipole process in Block 102.

Typically a quadrupole or octopole provides a reasonable degree of directivity (+4.7 dBi or +6.3 dBi, respectively). A higher order multipole, such as a hexadecapole or a 32-pole may provide even higher directivity. However these higher order multipoles are more difficult to phase and construct. In addition, as will be further explained later (see FIG. 6*b*), the gain of a quadrupole antenna goes roughly as the inverse of the fourth power of frequency. The gain of an octopole antenna goes roughly as the inverse of the sixth power of frequency. The gain of higher order multipoles falls off even more rapidly with decreasing frequency. Thus, one must balance the benefit of increased directivity with the detriment of decreased efficiency and gain when selecting an appropriate multipole as a starting point for DESA synthesis process 100.

The DESA synthesis process 100 continues with Phasing of a Multipole process in Block 203. The aim of this step is to align the signals so as to yield an exact cancellation in one direction. The partially cancelled signals in the other direction yield the resulting directional antenna patterns. The desired alignment is achieving by delaying (or equivalently, phasing) signals to or from the radiation centers of the antenna. Radiation centers may include feeds, sources, loads, cross-overs, terminations, or other loci within an antenna system where accelerating charges cause radiation energy to be transduced to or from a medium surrounding the antenna system. FIGS. 3*a*-3*c* further describe the Phasing of a Multipole process and resulting system.

The DESA synthesis process 100 continues with Connection of the Radiation Centers in Block 104. A key challenge in the construction of electrically small antennas is that transmission lines and support structures can couple to signals, distorting desired antenna patterns. Further, transmission lines must be closely impedance matched to terminations (or equivalently, loads) to avoid reflection. Unlike many conventional antennas where an S11 on the order of −10 dB (i.e. VSWR ~2:1) might be considered well-matched, to achieve an excellent front-to-back ratio, a DESA should exhibit −20 dB S11 (i.e. 1.22:1 VSWR) or better. FIGS. 4*a*-4*d* further describe the connection process and resulting directive antenna systems.

The DESA synthesis process 100 terminates at an End Block 105.

4.2.1 Phasing of Directive, Electrically Small Antennas

FIG. 2*a* presents a signal diagram of a directive quadrupole antenna system 200. FIGS. 2*a*-2*c* employ a common notation in which an upright source is denoted by a "+," an inverted source is denoted by a "−," an upright signal by a solid signal line with an arrowhead, and an inverted signal by a dashed signal line with an arrowhead. The length of a signal line denotes relative timing or delay. Directive quadrupole antenna system 200 includes an upright source 201 and an inverted source 202. Use of terms like "upright" and "inverted" are for descriptive purposes only and should not be interpreted as requiring any particular orientation of the overall directive quadrupole antenna system 200. In addition, although FIGS. 2*a*-2*c* are discussed in terms of "sources" emitting signals, equivalently the antenna systems of FIGS. 2*a*-2*c* may be thought of as comprising terminals receiving signals. Also, the present discussion compares signal propagating in a forward direction to signals propagating in a backward or reverse direction for purpose of illustrating key aspects of antenna system behavior. Omission of a more detailed analysis should not be interpreting as limiting use of the present invention is other or additional directions. FIGS. 2*a*-2*c* present a variety of multipole configurations of sources (equivalently, antenna feeds, radiation centers, or terminals).

A signal from the upright source 201 propagates forward, as denoted by upright forward signal line 206, and backward, as denoted by upright reverse signal line 205. At a later time, once the signal from the upright source 201 propagates a distance "d" to the vicinity of the inverted source 202, the inverted source 202 emits a forward propagating signal, as denoted by inverted forward signal line 204, as well as a backward propagating signal, as denoted by inverted reverse signal line 203. Inverted reverse signal 203 and upright reverse signal 205 are thus synchronized so as to substantially interfere destructively with each other, thus limiting transmission or reception of signals in the reverse direction. Forward upright signal 206 and forward inverted signal 204 only partially cancel, thus yielding a directive antenna pattern, typically with −3 dB beamwidth of about 137 deg.

FIG. 2*b* presents a signal diagram of a directive linear octopole antenna system 220. The directive linear octopole antenna system 220 includes a first upright source 221, a first inverted source 222, a second inverted source 223, and a second upright source 224 (collectively, "the sources"). The sources are arrayed in a substantially linear fashion.

A signal from the first upright source 221 propagates forward, as denoted by upright forward signal line 224, and backward, as denoted by upright reverse signal line 225. At a later time, once the signal from the first upright source 221 propagates a distance "d1" to the vicinity of the first inverted source 222, the first inverted source 222 emits a forward propagating signal, as denoted by inverted forward signal line 228, as well as a backward propagating signal, as denoted by inverted reverse signal line 229. At a still later time, once the signal from the upright source 221 has propagated a total distance "d2" to the vicinity of the second inverted source 223, the inverted source 223 emits a forward propagating signal, as denoted by inverted forward signal line 226, as well as a backward propagating signal, as denoted by inverted reverse signal line 227. At a still later time, once the signal from the upright source 221 has propagated a total distance "d3" to the vicinity of the second upright source 224, the second upright source 224 emits a forward propagating signal, as denoted by upright forward signal line 230, as well as a backward propagating signal, as denoted by upright reverse signal line 231. In an alternate but equivalent description first inverted source 222 and second inverted source 223 might be combined in a single source with twice the amplitude.

First inverted reverse signal 229, second inverted reverse signal 227, first upright reverse signal 225 and second upright reverse signal 231 are thus synchronized so as to substantially interfere destructively with each other, thus limiting transmission or reception of signals in the reverse direction. First forward upright signal 224, first inverted signal 228, second inverted signal 226, and second forward upright signal 230 only partially cancel, thus yielding a directive antenna pattern, typically with −3 dB beamwidth of about 104 deg.

FIG. 2*c* presents a signal diagram of a directive octopole antenna system 240. The directive octopole antenna system 240 includes a first upright source 241, a first inverted source 243, a second inverted source 244, and a second upright source 242 (collectively, "the sources"). The sources are arrayed in a substantially diamond-like fashion.

A signal from the first upright source 241 propagates forward, as denoted by upright forward signal line 248, and backward, as denoted by upright reverse signal line 247. At a later time, once the signal from the first upright source 241 propagates a distance "d4" to the vicinity of phase line "L" (connecting first inverted source 243 and second inverted source 244), the first inverted source 243 emits a forward propagating signal, as denoted by inverted forward signal line 250, as well as a backward propagating signal, as denoted by inverted reverse signal line 249. Also, second inverted source 244 emits a forward propagating signal, as denoted by inverted forward signal line 252, as well as a backward propagating signal, as denoted by inverted reverse signal line 251. At a still later time, once the signal from the first upright source 241 has propagated a total distance "d5" to the vicinity of the second upright source 242, the second upright source 242 emits a forward propagating signal, as denoted by upright forward signal line 248, as well as a backward propagating signal, as denoted by upright reverse signal line 247.

First inverted reverse signal 249, second inverted reverse signal 251, first upright reverse signal 247 and second upright reverse signal 245 are synchronized so as to substantially interfere destructively with each other, thus limiting transmission or reception of signals in the reverse direction. First forward upright signal 248, first inverted signal 250, second inverted signal 252, and second forward upright signal 246 only partially cancel, thus yielding a directive antenna pattern, typically with −3 dB beamwidth of about 88 deg.

These three examples illustrate a few of the possible phasing arrangements for a few simple multipole configurations. In general, the aim of the phasing process as taught by the present invention is to achieve a signal cancelation in one direction and thereby to achieve a directive antenna response in a substantially opposing direction.

4.2.2 Connection of Directive, Electrically Small Antennas

A key challenge in the construction of electrically small antennas is that transmission lines and support structures can couple to signals, distorting desired antenna patterns. In addition, even small mismatches result in reflected currents that can muddy nulls and damage front-back ratio. A muddied null impairs the antenna's ability to ignore undesired signals. The inventors discovered that one way to traverse this challenge is to design an antenna feed system so as to minimize radiation from feed lines and support structures. In a preferred embodiment, a carefully impedance matched connection reduces reflections and enhances front-back ratio.

FIG. 3*a* shows a diagram of a prior art center-fed small dipole element 300. Small dipole element 300 comprises a source or feed point 301 with approximately comparable first element 302 and second element 303 above and below feed 301, respectively. Prior art center-fed small dipole element 300 generates triangular current distribution 304, with current maximum at feed point 301 and antenna current tapering to zero at tips of first element 302 and second element 303.

FIG. 3*b* shows a diagram of an end-fed small dipole element 305. End-fed small dipole element 305 is fed with substantially equal and opposite currents from first end 306 and second end 307 generating elemental current 308 with uniform current distribution 309. In preferred embodiments, end-fed small dipole element 305 is a termination. A termination either includes impedance-matched resistive loading to minimize undesired reflections, or an impedance-matched system for recovering and recycling antenna energy. Substantially equal and opposing currents like those from first end 306 and second end 307 do not emit significant amounts of radiation until aligned in end-fed small dipole element 305 or similar such antenna structures.

FIG. 3*c* shows a diagram of a cross-over end-fed small dipole element 310. Cross-over small dipole element 310 is fed with substantially equal and opposite currents from first input end 311 and second input end 312 generating effective elemental current 313 with uniform current distribution 314. Cross-over small dipole element 310 passes substantially equal and opposite currents out first output end 315 and second output end 316. Effective elemental current 313 is twice the amplitude of comparable elemental current 308. Here again, substantially equal and opposing currents like those from first input end 311 and second input end 312 or those from first output end 315 and second output end 316 do not emit significant amounts of radiation until aligned in cross-over small dipole element 310 or similar such antenna structures.

In the context of the present invention, radiation sources may include prior art center-fed dipole elements like that of FIG. 3*a*, end-fed dipole elements like that of FIG. 3*b*, cross-over dipole elements like those of FIG. 3*c*, or any other antenna structure whose function is to serve as an energy source or sink within an antenna structure. A radiation center is a locus within an antenna system wherein a charge acceleration induces decoupling of bound or reactive energy and its transformation into radiation energy. A radiation center may include an antenna feed or source in the usual prior art sense. However, a radiation center may also include a load, cross-over, or other structure within an antenna system that imparts an uncancelled charge acceleration or deceleration. Similarly in the context of receiving signals, a radiation center is a locus within an antenna system where an incident electromagnetic wave imparts energy to an antenna system effecting the reception of a signal.

FIG. 3*d* shows the equivalence of a first directive electrically small transmit antenna 320 with a quadrupole distribution 330. First directive electrically small transmit antenna 320 comprises a source 321, a load 322, and twin lead transmission line 323. Twin lead transmission line 323 has equal and opposite currents in close proximity resulting in negligible radiation. Source 321 implements upright source 331 and resistive load 322 implements inverted source 332. Upright source 331 and inverted source 332 cooperate to form quadrupole 330. Resistive load 322 is impedance matched to transmission line 323. First directive electrically small transmit antenna 320 exhibits signal timing comparable to that of FIG. 2*a*.

FIG. 3*e* shows the equivalence of a first directive electrically small receive antenna 340 with a quadrupole distribution 350. First directive electrically small receive antenna 340 comprises a first signal coupler 341, a second signal coupler 342, and twin lead transmission line 343. Twin lead transmission line 343 has equal and opposite currents in close proximity resulting in negligible sensitivity to radiation. Signal coupler 341 implements upright element 351 and signal coupler 342 implements inverted element 352. Upright element 351 and inverted element 352 cooperate to form quadrupole 350. Signal coupler 341 connects to signal combiner 345. Signal coupler 342 connects to signal combiner 345 through delay line 344. Signal combiner 345 combines signals from signal coupler 341 and signal coupler 342 and conveys them to a receiver 346. Signal coupler 341 and signal coupler 342 may employ matched gain pre-amplifiers. First directive electrically small receive antenna 340 exhibits signal timing comparable to that of FIG. 2*a* upon suitable implementation of delay line 344. First directive electrically small receive antenna 340 illustrates how the concepts of the present invention may be applied for purposes of reception as easily as for transmission of signals.

FIG. 3*f* shows the equivalence of a second directive electrically small transmit antenna 360 with a linear octopole distribution 370. Second directive electrically small transmit antenna 360 comprises a source 361, a cross-over 362, a load 363, and twin lead transmission line 364. Cross-over 362 exhibits a topology comparable to that of cross-over end-fed small dipole element 310. Twin lead transmission line 364 has equal and opposite currents in close proximity resulting in negligible radiation. Source 361 implements first upright source 371, resistive load 363 implements second upright source 373, and crossover 362 implements first inverted source 372 and second inverted source 374. First upright source 371, second upright source 373, first inverted source 372, and second inverted source 374 cooperate to form linear octopole 370. Resistive load 363 is impedance matched to transmission line 364. Second directive electrically small transmit antenna 360 exhibits signal timing comparable to that of FIG. 2*b*.

FIG. 3*g* shows the equivalence of a third directive electrically small transmit antenna 380 with an octopole distribution 390. Third directive electrically small transmit antenna 380 comprises a source 381, a first cross-over 383, a second cross-over 384, a load 382, a first twin lead transmission line 385, and a second twin lead transmission line 386. Source 381 excites the first twin lead transmission line 385, and the second twin lead transmission line 386 (collectively, "the lines"). The lines are substantially orthogonal to each other, thus each accepting half the current from source 381. The currents in the lines are equal and opposite, resulting in negligible radiation. At first cross-over 383, first twin-lead transmission line 385 is inverted. At second cross-over 384, second twin-lead transmission line 386 is inverted. Source 381 implements upright dipole 391, first cross-over 383 implements inverted dipole 392, second cross-over 384 implements inverted dipole 393, and load 382 implements upright dipole 394, thus making third directive electrically small transmit antenna 380 analogous to octopole distribution 390. Octopole distribution 390 comprises upright dipole 391, inverted dipole 392, inverted dipole 393, and upright dipole 394. Signals propagating in the lines to the crossovers and then to terminating load 382 traversed a path 40% longer than the direct free-space path between source 381 and load 382. Thus, the cancellation was not as precise as those portrayed in FIG. 2*c*. However, the partial cancellation still achieved a more directive pattern response than the original quadrupole design. The slight asymmetry in the transmission lines needed to implement the crossover can impart a small reflection yielding some distortion in the antenna pattern and filling in of the null, as shown in FIG. 5*a*. Third directive electrically small transmit antenna 380 may also be referred to as a "quasi-octopole" antenna, because it exhibits signal timing comparable to but not exactly the same as those portrayed in FIG. 2*c*.

4.3 Embodiments

FIG. 4*a* presents a preferred embodiment directive quadrupole antenna system 400. Preferred embodiment directive quadrupole antenna system 400 comprises feed point 401, twin lead transmission line 402, terminating load 403, balun transformer 404 and connector 405. Connector 405 couples coaxial guided signals to transformer 404. In the preferred embodiment, transformer 404 is a 3:1 transformer, transforming a 50 ohm coaxial signal into a differential 150 ohm signal. Twin lead transmission line 402 comprises two 75 ohm coaxial cables conveying a differential 150 ohm signal to feed 401. Feed 401 cross connects signals contained within each coaxial cable to the exterior of the other. A differential 150 ohm signal propagates the length of the twin lead line before terminating in 150 ohm load 403. Specific impedances and transformer ratios should be taken as illustrative of a particular preferred embodiment and not as limiting.

FIG. 4*b* presents an alternate embodiment directive quadrupole antenna system 420. Alternate embodiment directive quadrupole antenna system 420 includes first conductor 421 and second conductor 422. If first conductor 421 and second conductor 422 are characterized by a diameter "D" and are generally co-parallel separated by distance "d," then first conductor 421 and second conductor 422 cooperate to form a twin-lead transmission line with impedance:

$$Z = \frac{Z_s}{\pi\sqrt{\varepsilon_r}}\cosh^{-1}\frac{D}{d} \tag{2}$$

where Zs=376.7 ohm is the impedance of free space, and $s_r$ is the relative dielectric constant of the surrounding space (for free space $\in_r$=1). In general, the length "L" of alternate embodiment directive quadrupole antenna system 420 is greater than separation distance "d." Coaxial cable 423 preferably routes inside first conductor 421, entering in the vicinity of terminating load 424. Thus coaxial cable 423 may be routed in the direction of the antenna null so as to minimize the risk of coupling. Coaxial cable 423 emerges at the other end of alternate embodiment directive quadrupole antenna system 420, and couples via transformer 425 to comprise a feed point. Transformer 425 transforms the impedance of coaxial cable 423 to match the impedance of the twin lead transmission line formed by the combination of first conductor 421 and second conductor 422.

4.4 Comparison of Additional Embodiments

FIG. 5*a* shows typical azimuthal patterns 500 for three DESAs. In NEC simulations, a quadrupole exhibits a typical beamwidth of about 137 deg. A Linear Octopole exhibits a typical beamwidth of about 104 deg. A typical Quasi-Octopole exhibits a beamwidth of about 88 deg. These gain results are for free space. When ground or other objects approach near-field range of the antenna (within perhaps a half-wavelength or so), coupling to external objects may distort the antenna pattern.

FIG. 5*b* shows gain versus frequency results 550 for DESAs compared to target gain. The target gain is determined by evaluating the minimum ambient noise to be expected at a particular frequency. Unlike microwave links that may be thermal noise limited, high frequency (HF: 3-30 MHz) links must operate in the presence of substantial noise. The design goal then is to target an antenna gain on par with the minimum expected ambient noise over thermal. The goal can be refined from this starting point in contexts where antenna directivity may be including or excluding specific noise sources based on their location relative to the antenna pattern, At 10 MHz, for instance, 30 dB of RF noise over thermal is the minimum to be expected. A receive antenna with an efficiency greater than −30 dB is merely enhancing ambient noise and not improving overall signal-to-noise ratio. Atmospheric noise may rise to 40 dB and in an urban area RF noise of 50 dB of over thermal may be experienced at this frequency. In general, lower frequencies experience higher noise levels [see: International Telecommunication Union, Recommendation ITU-R P.372-8: Radio noise, 2003, as cited in NATO RTO Technical Report, "HF Interference, Procedures, and Tools," RTO-TR-IST-050, June 2007, pp. 2-11 to 2-12].

A NEC analysis of a variety of embodiments along the lines taught by the present invention is presented in gain versus frequency plot 550 and compared to the target gain as defined above. In each case, the antenna is constructed out of parallel 8 cm diameter pipes separated by 50 cm spacing to yield a nominal impedance on the order of 300 ohms. The Quadrupole and Linear Octopole antennas are matched to 300 ohm. The Octopole, comprising parallel 300 ohm lines at the feed point, is matched to 150 ohm. In each case, copper elements were assumed. These details are provided to aid the reader in evaluating the performance of the specific embodiments described and analyzed in the plots of FIG. 5*a* and FIG. 5*b*, not for purposes of limitation. A few of the conclusions to be drawn from this analysis are as follows.

Unlike electrically small dipole antennas whose gain rolls off as 20 dB/decade, electrically small quadrupoles have a gain relationship on the order of a 40 dB roll-off per decade of frequency. For electrically small octopoles, the relationship is about 60 dB per decade.

Although the gain roll-off of a higher order multipole is more severe, there can be ranges of operation for which a comparably sized higher order multipole antenna out performs a lower order multipole antenna. For instance, a 5 m long Linear Octopole antenna outperforms a 5 m long Quadrupole antenna above 12 MHz. For frequencies below 12 MHz, the Quadrupole has superior performance.

4.5 Antenna Regeneration

The present invention explores the use of loss to create ultra-wideband (UWB) electrically-small directive antennas. Obviously, this does not lend itself well to creating highly efficient antenna designs. The classic technique for improving performance of electrically small antennas is by employing resonance phenomena—match inductive and capacitive reactance to make energy oscillate between magnetic and electric manifestations (respectively). But resonance carries with it the disadvantage that the more efficient the resonant system, the narrower the bandwidth an effect that has been dubbed the "tyranny of resonance." The present invention teaches an alternative to resonant antennas: "regenerative" antennas—antennas that recirculate energy using means other than resonance. This section discusses these concepts in detail.

4.5.1 The Tyranny of Resonance

Electrically small antennas are notoriously inefficient. The classical way to address these problems is by eliminating losses—using Litz wire, silver coating conductors, and other such techniques to minimize ohmic resistance of the antenna structure. By reducing losses and implementing a balance of capacitive and inductive reactance, an electrically small antenna may be made to resonate at a particular center frequency ($f_C$). The Quality Factor ("Q") is a measure of the ratio of the inductive reactance ($X_L$) to the ohmic loss (R):

$$Q = \frac{X_L}{R} = \frac{2\pi f_C L}{R} = \frac{f_C}{BW} \tag{3}$$

[See: Estill I. Green, "*The Story of Q*," American Scientist, Vol. 43, October 1955, pp. 584-594]. A high quality factor implies a relatively narrow bandwidth. A typical "good" resonant antenna might have a quality factor Q=100. Such an antenna would have a bandwidth BW=1001(Hz at a center frequency fC=10 MHz. With heroic effort, one might achieve a quality factor as high as 1000, but the resulting bandwidth will be correspondingly narrower. High Q antennas recirculate energy multiple times. The number of times energy recirculates in a high Q antenna corresponds roughly to "Q." Thus, a Q=1000 antenna recirculates energy approximately 1000 times achieving about a 30 dB enhancement in efficiency from what a low Q antenna would achieve. One critical point must be understood: minimizing antenna loss is not an end in itself. It is a means to the end of enhancing resonant recirculation of energy through an antenna. This high Q recirculation enhances antenna performance, greatly multiplying the effect of loss reduction on any particular circulation of energy through the antenna system. This performance comes with a price.

Extremely high Q antennas are delicately balanced to operate over a narrow frequency range. The slightest variation in parasitic capacitance can throw a high Q antenna off the desired frequency. To increase stability and bandwidth, one might add loss: terminate the antenna in a resistance to avoid reflections and maintain stable antenna pattern behavior. This approach is often applied in electrically-small directive antenna designs. The classic antenna of this kind is the "travelling wave" antenna historically used to create directional, long-wavelength antennas. To increase stability and bandwidth, one might add loss: terminate the antenna in a resistance to avoid reflections and maintain stable antenna pattern behavior. This is the approach Q-Track has applied in some of our designs electrically small directive antenna designs. The classic antenna of this kind is the "travelling wave" antenna historically used to create directional, long-wavelength antennas. However lossy antennas are inefficient.

Q-Track offers a novel solution to this challenging problem. We suggest an alternative to resonant antennas which we have dubbed "regenerative" antennas—antennas that recirculate energy using means other than resonance. Regenerative antennas can thus achieve the benefits of traditional resonant designs while avoiding their shortfalls and disadvantages. The following sections describe the concept of antenna regeneration in further detail.

FIG. 6*a* shows a power flow diagram for a resistively terminated antenna system 600. Resistively terminated antenna system 600 comprises source 601, transmission line 602, and load 603. For any unit of energy fed into resistively terminated antenna system 600, a certain fraction decouples and radiates away ($\eta_{ant}$), a certain fraction is lost in the intrinsic ohmic resistance of the antenna transmission line 602 ($\eta_{loss}$), and the largest fraction of energy dissipates in the terminating load 603 ($\eta_{load}$). All the power fraction dissipated in the terminating load 603 ($\eta_{load}$) is completely lost to the antenna and wasted.

4.5.2 Antenna Regeneration Power Flow and Efficiency

Now suppose one could capture this power dissipated in the terminating load and recycle it back through the antenna, giving it an additional opportunity to be radiated. This is the idea behind antenna regeneration. Suppose notionally that instead of dissipating power in the terminating load, one recycles or regenerates the power with a regeneration efficiency $\eta_{in}$.

FIG. 6*b* shows a power flow diagram for a regenerative antenna system 650. Regenerative antenna system 650 comprises source 651, transmission line 652, and regenerative load 653. Just as a resonant antenna recirculates energy multiple times so as to maximize the likelihood of radiation, a regenerative antenna involves recirculating energy using mechanisms other than resonance. Unlike a conventional load that dissipates RF energy as heat, regenerative load 653 captures RF energy making it available for reuse while behaving as a resistive termination in regenerative antenna system 650.

The total efficiency of a regenerative antenna may be expressed in terms of a power series:

$$\begin{aligned}\eta_{tot} &= \eta_{ant} + (1-\eta_{ant}-\eta_{loss})\eta_{reg}\eta_{ant} + \\ &\quad (1-\eta_{ant}-\eta_{loss})^2\eta_{reg}^2\eta_{ant} + (1-\eta_{ant}-\eta_{loss})^3 \\ &\quad \eta_{reg}^3\eta_{ant} + \ldots \\ &= \eta_{ant}(1 + (1-\eta_{ant}-\eta_{loss})\eta_{reg} + \\ &\quad (1-\eta_{ant}-\eta_{loss})^2\eta_{reg}^2 + \\ &\quad (1-\eta_{ant}-\eta_{loss})^3\eta_{reg}^3 + \ldots) \\ &= \eta_{ant}\frac{1}{1-(1-\eta_{ant}-\eta_{loss})\eta_{reg}} \\ &\approx \eta_{ant}\frac{1}{1-\eta_{reg}} \text{ where } \eta_{reg} >> \eta_{ant}+\eta_{loss}\end{aligned} \tag{4}$$

This power series is readily simplified once recognized as a geometric series. Just as with a high Q antenna, the efficiency of a regenerative antenna is enhanced by approximately the effective number of times we can recirculate energy through the antenna before that energy is dissipated through losses in the regeneration process. A regeneration efficiency of 0.9 is equivalent to an effective Q of about 10, a regeneration efficiency of 0.99 is equivalent to an effective Q of about 100, a regeneration efficiency of 0.999 is equivalent to an effective Q of about 1000, and so on. Equation 5 mathematically defines this relationship:

$$Q_{eff} \approx \frac{1}{1-\eta_{reg}} \text{ where } \eta_{reg} >> \eta_{ant}+\eta_{loss} \tag{5}$$

The Table below presents additional results.

| $\eta_{reg}$ | $(1-\eta_{reg})^{-1}$ |
|---|---|
| 0.5 | 2 |
| 0.8 | 5 |
| 0.9 | 10 |
| 0.95 | 20 |
| 0.98 | 50 |
| 0.99 | 100 |
| 0.995 | 200 |
| 0.999 | 1000 |

The key point of this analysis is the observation that with a high enough regeneration efficiency, a regenerative antenna will be able to emulate the performance of a high Q antenna, without any bandwidth limitations. Antenna regeneration is reminiscent of "Q-multiplication." Q-multiplication is the use of amplification to overcome losses in a resonant antenna system to cancel out loss and therefore increase effective Q. However, Q-multiplication increases the two-way flow or oscillation of antenna energy and currents back and forth. The goal of antenna regeneration is to increase the effective one-way flow of antenna energy. In other words, Q-multiplication enhances the ebb and flow of antenna energy, while regeneration aims to enhance only the flow.

4.5.3 Antenna Regeneration Process

FIG. 7*a* shows a flow diagram for transmit antenna regeneration process 700. Transmit antenna regeneration process 700 begins at start block 701. Transmit antenna regeneration process 700 continues with the step of Launching a Wave in process block 702. In this process step, a wave is launched in and around an antenna system. An antenna system is preferably a multipole antenna system such as a quadrupole, a linear octopole, a quasi-octopole, or other multipole antenna system. A multipole antenna system may be thought of as an antenna system comprising radiation loci arranged in a multipole configuration.

Transmit antenna regeneration process 700 continues with the step of Radiation in process block 703. As the wave launched in the Launching a Wave step 702 induces acceleration of charges, some previously bound or coupled energy dissociates from the antenna and radiates away. This fraction of energy is likely to be relatively small for a DESA system.

Transmit antenna regeneration process 700 continues with the step of Recovery in process block 704. The technique of resistive loading of antennas is understood in the prior art. Such prior art loads dissipate energy in the irrecoverable form of ohmic losses. One key inventive step herein disclosed is the use of a load that actually converts captured energy into a form where the captured energy can be recovered, recycled, and reused, thus dramatically improving antenna efficiency. As will be shown in later embodiments, a process block 704 Recovery may convert RF energy to DC, enabling power to be shunted to a power amplifier. A process block 704 Recovery may shunt RF energy back to an antenna feed point accepting the inefficiency of a potential phase mismatch. A process block 704 Recovery may shunt RF energy back to an antenna feed point adjusting for phase mismatch or otherwise conditioning or modifying the RF signal so as to enhance the efficiency of the process. A wide variety of specific process block 704 Recovery implementations are possible.

Transmit antenna regeneration process 700 continues with the step of Recycling in decision block 705. In general, a regenerative antenna will be configured to recycle energy automatically so that a Transmit Antenna Regeneration Process 700 continues with the step of Reuse in process block 706. In the Reuse step 706, energy recovered in Recover step 704 is reintroduced through Launch Wave step 702. Reuse step 706 may include employing DC power to power a transmit amplifier, or coupling RF energy of one form or another back to a regenerative antenna feed point. RF energy may be at a radio frequency substantially equivalent to that involved in the step of Launching a Wave 702, or at another convenient frequency. Reuse step 706 causes energy to be recirculated through a regenerative antenna at least once, but preferentially many times.

Ultimately however, after many cycles through Transmit antenna regeneration process 700 with diminishing returns, any given unit of transmit energy will be sufficiently reduced so as to be irrecoverable, leading Recycle decision block 705 to terminate Transmit Antenna Regeneration Process 700 in End block 707.

FIG. 7*b* shows a flow diagram for receive antenna regeneration process 750. Receive antenna regeneration process 750 begins at Start block 751. Receive antenna regeneration process 750 continues with the step of Receiving the $i^{th}$ Signal in process block 752. Receive antenna regeneration process 750 continues with the More decision in decision block 753. If additional signals are available to capture, index "i" is incremented and receive antenna regeneration process 750 continues in block 752 with the step of Receiving the $(i+1)^{th}$ signal. Once all N signals are collected, receive antenna regeneration process 750 continues in process block 754 with the step of Multipole Phasing N Signals. This phasing arranges signals along the lines of FIG. 2*a*-2*c*. Receive antenna regeneration process 750 continues in process block 755 with the step of Summing N Signals before terminating in End block 756.

4.5.4 Antenna Regeneration Embodiments

FIG. 8*a* shows a power flow diagram for a rectifying regenerative antenna system 800. Rectifying regenerative antenna system 800 comprises power source 810, signal source 801, transmit amplifier 802, feed point 803, transmission line 804, and regenerative load 805. Regenerative load 805 comprises termination coupler 806, rectifier 807, filter capacitor 808, and regenerative coupling 809.

Power source 810 is imagined as a battery for purpose of illustration. Power source 810 provides power to transmit amplifier 802 so as to amplify a signal from signal source 801. Transmit amplifier 802 has efficiency $\eta_{TX}$. Transmit amplifier 802 couples to transmission line 804 at feed point 803. Transmission line 804 has loss $\eta_{loss}$ and rectifying regenerative antenna system 800 exhibits a single pass radiation efficiency Regenerative load 805 captures energy from transmission line 804 with regeneration efficiency $\eta_{reg}$. Termination coupler 806 captures RF energy from transmission line 804 and conveys it to rectifier 807. Rectifier 807 converts RF power to pulsed DC and couples the pulsed DC power to filter capacitor 808 with rectification efficiency $\eta_{rect}$. Filter capacitor 808 feeds smoothed DC power via regenerative coupling to power source 810. Overall regeneration efficiency is $\eta_{reg}=\eta_{rect}\eta_{TX}$.

The inventors designed an impedance matched rectifier and simulated it in PSpice. In our model, we ended up with 1280 W of transmit power. The antenna losses were 9.0 W. Rectification losses were 35.2 W. Loss from the internal resistance of the battery was 13.3 W. So of the total 1280 W applied to the antenna, 1222 W (95.5%) was returned back to the battery. A high efficiency (95% efficient) transmitter would yield a total regeneration efficiency of 90.7%. Rectifying regenerative antenna system 800 is well suited for antennas used in high power transmission systems in which RF voltages greatly exceed rectifier diode switching voltages. As noted above, a 90% regeneration efficiency implies performance comparable to a Q=10 antenna without bandwidth limitation.

FIG. 8*b* shows a power flow diagram for a transformer coupled regenerative antenna system 820. A transformer coupled regenerative antenna system 820 comprises signal source 821, combining transformer 822, feed point 823, transmission line 824, and regenerative load 825. Regenerative load 825 comprises termination coupler 826, regenerative coupling 827 and combining transformer 822.

In the context of transformer coupled regenerative antenna system 820, signal source 821 may include a power source and transmitter means. Combining transformer 822 combines power from signal source 821 and regenerative coupling 827 in order to effect the regeneration with transformer efficiency $\eta_{xform}$. The combined power is applied to the antenna transmission line 824 at feed point 823. Transmission line 824 has loss $\eta_{loss}$ and transformer coupled regenerative antenna system 820 exhibits a single pass radiation efficiency $\eta_{ant}$. Regenerative load 825 captures non-radiated RF energy from transmission line 824 with regeneration efficiency $\eta_{reg}$. Termination coupler 826 captures non-radiated RF energy from transmission line 824 and conveys it to combining transformer 822 via regeneration coupling 827. A transformer coupled regenerative antenna system 820 inputs the non-radiated energy via transformer coupling 826. In this kind of regenerative antenna, regeneration coupling 827 comprises a matched impedance transmission line 827 conveying RF energy from termination coupler 826 back to the feed point where a transformer 822 couples the RF energy back into the antenna for another circulation through transformer coupled regenerative antenna system 820. One way in which this might be accomplished in the context of a twin lead transmission line antenna would be to embed a transformer coupled recirculative coaxial transmission inside antenna transmission line 824. In another embodiment, matched impedance transmission line 827 may be a twin lead impedance line of matched impedance embedded within antenna transmission line 824. This embodiment avoids losses due to transformer coupling between balanced antenna transmission line 824 and unbalance lines. The regeneration efficiency of this approach depends on losses in recirculative transmission line as well as the transformer efficiency. The inventors anticipate overall regeneration efficiencies of 95-99% may be achievable through this approach. Here again, impedance matching is critical. Even small mismatches are likely to generate reflections that make the antenna resonate instead of exhibit uniform one-way energy propagation. Termination coupler 826 may preferentially involve a circulator to keep energy flowing in the same direction and assist in terminating undesired mismatch reflections. In the context of a receive application, termination coupler 826 may also employ gain to partially cancel out the implementation loss. Gain of an amplifying terminating coupler 826 must be carefully adjusted to avoid making a receive regenerative antenna oscillate.

One limitation of a direct transformer coupled regenerative antenna 820 is the extra phase delay induced by the recirculative transmission line 827 in coupling RF energy from the termination coupler 826 back to the coupling transformer 822. If the overall dimensions of a direct transformer coupled regenerative antenna 820 are very small compared to a characteristic wavelength of operational signals, then these phase offsets may be negligible, and recirculated energy will add substantially in phase with energy from a signal source 821.

However, if the electrical length of transformer coupled regenerative antenna 820 and recirculative transmission line 827 become long enough, and the effective number of recirculative cycles becomes large enough, then a direct recirculation regenerative antenna will begin adding energy out-of-phase with energy from the transmitter, impairing performance.

FIG. 8*c* shows a power flow diagram for a phase corrected transformer coupled regenerative directive quadrupole antenna system 840. By introducing a phase shifter 841, the regeneration circuit can combine RF energy in phase with energy from a transmitter (or detected by a receiver). The difficulty with implementing a phase shifter 841 is that the desired phase shift depends on frequency. In one implementation, the phase shifter may be a multiplexing filter that applies various phase shifts to signals within various frequency bands: a ninety degree phase shift for a first band, 180 degrees for a next band and so on. In addition, the transformer may be designed so as to invert signals as part of an overall phase shifting scheme.

In any event, introducing a phase shifter 841 will introduce additional loss relative to a standard direct recirculation architecture just as that of transformer coupled regenerative antenna 820. Phase shifter 841 may offset phase mismatch or dispersion regeneration loss by adding recirculating signals together coherently and in phase. In the context of a receive application, phase shifter 841 may amplify signals to cancel out implementation losses in the regeneration, provided the amplification is not so great as to exceed losses and cause oscillation.

4.6 Applications

DESAs have a wide variety of applications. These antennas work well in any application where the practical size of a directive antenna must be of the dimension of the radian-sphere or smaller. This section discusses a few actual and potential applications and is not intended to be exhaustive or comprehensive, only illustrative. These applications may include low frequency ground penetrating radar systems, compact antennas for HF and lower frequency amateur radio operations, and over-the-horizon radar systems. In addition, the process of regeneration opens vast new opportunities in improving antenna efficiency.

Near-field electromagnetic ranging real-time location systems are also a potential application. Incumbent location providers take high frequency, short wavelength wireless systems, like Wi-Fi or UWB, that were optimized for high data rate communications, and they try to use them to solve the challenging problem of indoor wireless location. But location and communication are two fundamentally different problems requiring fundamentally different solutions, particularly in the most challenging RF propagation environments.

Applicants have pioneered a solution. "Near-field electromagnetic ranging" (NFER®) technology offers a wireless physical layer optimized for real-time location in the most RF hostile settings. NFER® systems exploit near-field behavior within about a half wavelength of a tag transmitter to locate a tag to an accuracy of 1-3 ft, at ranges of 60-200 ft, all at an infrastructure cost of $0.50/sqft or less for most installations. NFER® systems operate at low frequencies, typically around 1 MHz, and long wavelengths, typically around 300 m. FCC Part 15 compliant, low-power, low frequency tags provide a relatively simple approach to wireless location that is simply better in difficult environments.

Low frequency signals penetrate better and diffract or bend around the human body and other obstructions. This physics gives NFER® systems long range. There's more going on in the near field than in the far field. Radial field components provide the near field with an extra (third) polarization, and the electric and magnetic field components are not synchronized as they are for far-field signals. Thus, the near field offers more trackable parameters. Also, low-frequency, long-wavelength signals are resistant to multipath. This physics gives NFER® systems high accuracy. Low frequency hardware is less expensive, and less of it is needed because of the long range. This makes NFER® systems more economical in more difficult RF environments.

Near field electromagnetic ranging was first fully described in applicant's "System and method for near-field electromagnetic ranging" (Ser. No. 10/355,612, filed Jan. 31, 2003, now U.S. Pat. No. 6,963,301, issued Nov. 8, 2005). This application is incorporated in entirety by reference. Some of the fundamental physics underlying near field electromagnetic ranging was discovered by Hertz [Heinrich Hertz, Electric Waves, London: Macmillan and Company, 1893, p. 152]. Hertz noted that the electric and magnetic fields around a small antenna start 90 degrees out of phase close to the antenna and converge to being in phase by about one-third to one-half of a wavelength. This is one of the fundamental relationships that enable near field electromagnetic ranging. A paper by one of the inventors [H. Schantz, "Near field phase behavior," 2005 IEEE Antennas and Propagation Society International Symposium, Vol. 3A, 3-8 July, 2005, pp. 237-240] examines these near-field phase relations in further detail. Link laws obeyed by near-field systems are the subject of another paper [H. Schantz, "Near field propagation law & a novel fundamental limit to antenna gain versus size," 2005 IEEE Antennas and Propagation Society International Symposium, Vol. 3B, 3-8 July, 2005, pp. 134-137].

Near-field electromagnetic ranging is particularly well suited for tracking and communications systems in and around standard cargo containers due to the outstanding propagation characteristics of near-field signals. This application of NFER® technology is described in applicant's "Low frequency asset tag tracking system and method," (Ser. No. 11/215,699, filed Aug. 30, 2005, now U.S. Pat. No. 7,414,571, issued Aug. 19, 2008). An NFER® system also provides the real-time location system in a preferred embodiment of applicants' co-pending "Asset localization, identification, and movement system and method" (Ser. No. 11/890,350, filed Aug. 6, 2007, now U.S. Pat. No. 7,957,833, issued Jun. 7, 2011). All of the above listed U.S. patent and patent applications are hereby incorporated herein by reference in their entirety.

In addition, applicants recently discovered that AM broadcast band signals are characterized by "near field" behavior, even many wavelengths away from the transmission tower. These localized near-field signal characteristics provide the basis for a "Method and apparatus for determining location using signals-of-opportunity" (Ser. No. 12/796,643, filed Jun. 8, 2010, now U.S. Pat. No. 8,018,383, issued Sep. 13, 2011). This U.S. Patent is hereby incorporated herein by reference in its entirety.

Applicants also discovered that a path calibration approach can yield successful first responder rescues, as detailed in applicant's "Firefighter location and rescue equipment" (Ser. No. 13/021,711, filed Feb. 4, 2011). This U.S. Patent application is hereby incorporated herein by reference in its entirety. These and other aspects of near-field electromagnetic ranging technology can benefit from the possibility of employing DESAs.

Applicants have presented specific applications and instantiations throughout the present disclosure solely for purposes of illustration, to aid the reader in understanding a few of the great many implementations of the present invention that will prove useful. It should be understood that, while the detailed drawings and specific examples given describe preferred and exemplary embodiments of the invention, they are for purposes of illustration only, that the system of the present invention is not limited to the precise details and conditions disclosed, and that various changes may be made therein without departing from the spirit of the invention, as defined by the following claims:

The invention claimed is:

1. An electrically-small directive antenna system comprising a twin lead transmission line and at least one load and further comprising a multipole configuration of radiation centers, the radiation centers emitting or receiving signals, and the radiation centers phased so as to yield a substantial cancellation of the signals in at least one direction resulting in a directive antenna pattern and wherein the twin-lead transmission line is impedance matched to at least one load, wherein the twin-lead transmission line is characterized by a length greater than a separation distance, and wherein the length is less than a quarter wavelength at a frequency of operation.

2. The electrically-small directive antenna system of claim 1 wherein the load is regenerative.

3. The electrically-small directive antenna system of claim 1 further including a cross-over.

4. The electrically-small directive antenna system of claim 1 further including an impedance transformer.

5. The electrically-small directive antenna system of claim 1 further including a second transmission line embedded within the twin-lead transmission line.

6. The electrically-small directive antenna system of claim 1 wherein the multipole is a quadrupole.

7. The electrically-small directive antenna system of claim 1 wherein the multipole is an octupole.

8. An electrically-small directive antenna system comprising a feed point, a load, and a twin-lead transmission line between the feed-point and the load, wherein the twin-lead transmission line is impedance matched to the load, wherein the twin-lead transmission line is characterized by a length greater than a separation distance, and wherein the length is less than a quarter wavelength at a frequency of operation.

9. The electrically-small directive antenna system of claim 8 further including at least one cross-over.

10. The electrically-small directive antenna system of claim 8 further including an impedance transformer.

11. The electrically-small directive antenna system of claim 8 further including a second transmission line embedded within the twin-lead transmission line.

12. The electrically-small directive antenna system of claim 8 wherein the load is a regenerative load.

13. The electrically-small directive antenna system of claim 12 wherein the regenerative load employs rectification.

14. The electrically-small directive antenna system of claim 12 wherein the regenerative load employs transformer coupling.

15. The electrically-small directive antenna system of claim 12 wherein the regenerative load employs a phase shifter.

16. The electrically-small directive antenna system of claim 12 wherein the regenerative load employs amplification.

17. The electrically-small directive antenna system of claim 8 wherein the load and the feed point form a multipole configuration of radiation centers phased so as to yield a substantial cancellation of the signals in at least one direction resulting in a directive antenna pattern.

* * * * *